US010398208B2

(12) United States Patent
Marcin et al.

(10) Patent No.: US 10,398,208 B2
(45) Date of Patent: Sep. 3, 2019

(54) HAIRSTYLING APPARATUS AND KIT

(71) Applicants: Scott Marcin, East Stroudsburg, PA (US); Sandra Marcin, East Stroudsburg, PA (US)

(72) Inventors: Scott Marcin, East Stroudsburg, PA (US); Sandra Marcin, East Stroudsburg, PA (US)

( * ) Notice: Subject to any disclaimer, the term of this patent is extended or adjusted under 35 U.S.C. 154(b) by 323 days.

(21) Appl. No.: 15/251,280

(22) Filed: Aug. 30, 2016

(65) Prior Publication Data

US 2018/0055180 A1 Mar. 1, 2018

(51) Int. Cl.
*A45D 2/14* (2006.01)
*A45D 2/12* (2006.01)

(52) U.S. Cl.
CPC ..... *A45D 2/146* (2013.01); *A45D 2/125* (2013.01); *A45D 2200/25* (2013.01)

(58) Field of Classification Search
CPC .... A45D 2/146; A45D 2/125; A45D 2200/25; A45D 2/127; A45D 2/18; A45D 2/20
See application file for complete search history.

(56) References Cited

U.S. PATENT DOCUMENTS 1,495,054 A * 5/1924 West ..... A45D 2/125 132/250
1,774,390 A 8/1930 McGrath
1,886,731 A * 11/1932 Plate ..... A45D 2/125 132/246
2,103,534 A * 12/1937 Huppert ..... A45D 2/20 132/246
2,138,905 A * 12/1938 Coggans ..... A45D 2/125 132/250
2,163,894 A * 6/1939 Seidel ..... A45D 2/125 132/250
2,274,170 A 2/1942 Stanley
2,308,167 A * 1/1943 Fulton ..... A45D 2/18 132/248
2,434,279 A 1/1948 McDonough et al.
2,485,686 A * 10/1949 Bacon ..... A45D 2/125 132/249
2,489,120 A * 11/1949 Carlin ..... A45D 2/125 132/246
2,537,728 A * 1/1951 Wright ..... A45D 2/125 132/248
2,557,060 A * 6/1951 Frishberg ..... A45D 2/18 132/122

(Continued)

*Primary Examiner* — Nicholas D Lucchesi
(74) *Attorney, Agent, or Firm* — Global Intellectual Property Agency, LLC; Daniel Boudwin

(57) ABSTRACT

A hair styling apparatus for styling hair of a user comprises a tubular base member, elastic loop elements, and gripping members. The tubular base member comprises a first end and a second end, receives, and rolls hair of a user. The elastic loop elements are fixedly attached to the first end and the second end of the tubular base member. The gripping members are fixedly attached to each of the elastic loop elements for overlapping the elastic loop elements over the tubular base member. The elastic loop elements securely fasten the hair of the user to the tubular base member for styling the hair of the user. Further, the hair styling apparatus kit comprises an elongate curling wand device with clip designed for supplying added definition to the hair.

5 Claims, 4 Drawing Sheets

(56) References Cited

U.S. PATENT DOCUMENTS

| | | | | | |
|---|---|---|---|---|---|
| 2,563,421 | A * | 8/1951 | Roth | A45D 2/20 | 132/250 |
| 2,729,217 | A * | 1/1956 | Grasso | A45D 2/127 | 132/246 |
| 2,754,832 | A * | 7/1956 | Garland | A45D 2/146 | 132/246 |
| 2,762,379 | A * | 9/1956 | Grasso | A45D 2/18 | 132/253 |
| 3,412,738 | A * | 11/1968 | Hensley | A45D 2/146 | 132/251 |
| 5,460,190 | A * | 10/1995 | Bondick | A45D 2/18 | 132/233 |
| 6,374,830 | B1 * | 4/2002 | Afeworki | A45D 2/146 | 132/250 |
| 9,820,545 | B2 * | 11/2017 | Simonson | A45D 2/127 | |
| 2006/0016456 | A1 | 1/2006 | Rashied | | |
| 2009/0084397 | A1 * | 4/2009 | Park | A45D 2/12 | 132/250 |
| 2013/0186420 | A1 * | 7/2013 | Oates | A45D 2/122 | 132/200 |

* cited by examiner

HAIRSTYLING APPARATUS AND KIT

BACKGROUND OF THE INVENTION

A. Technical Field

The present invention generally relates to hair styling. More particularly, the invention relates to a hair styling apparatus and kit for styling hair of a user.

B. Description of Related Art

Traditionally, many individuals spend large amounts of money in order to visit a salon for styling hair. Styling hair requires the stylist to use a curling rod or a flat iron to get a desired look. Conventional flat irons use heat to manipulate the hair into a variety of waves, curls, and reversing natural curls. Curling hair using a styling iron can damage it due to direct heat from the iron. For example, the customer may wind up with burnt tips of the hair, which would then need to be cut off. Moreover, creating curls will consume a lot of time and repeated visits to nearby salon or beauty parlors.

Furthermore, various hair styling tools such as blow dryers, curlers, etc., are used for maintaining the straightened hair. However, this requires the user to spend a prolonged period to style the hair. The user needs to learn how to safely use these tools and exercise caution while using devices such as styling irons. Therefore, a hair styling apparatus, which reduces the time needed for styling hair, is required. In addition, a hair styling apparatus, which can be utilized to style one's hair by creating different forms of curls without the application of heat, is required.

Hence, there is a long felt but unresolved need for a hair styling apparatus, which can be utilized to form curls on hair without the application of heat. Furthermore, there is a need for a hair styling apparatus, which reduces the time required for styling hair.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The invention disclosed herein addresses the above-mentioned need for a hair styling apparatus, which can be utilized to style one's hair without the application of heat. Furthermore, the invention addresses the need for a hair styling apparatus, which reduces time for styling hair. The hair styling apparatus disclosed herein for styling hair of a user comprises a tubular base member, elastic loop elements, and gripping members. The tubular base member comprises a first end and a second end, receives, and rolls hair of a user. The elastic loop elements are fixedly attached to the first end and the second end of the tubular base member. The gripping members are fixedly attached to each of the elastic loop elements for overlapping the elastic loop elements over the tubular base member. The elastic loop elements securely fasten the hair of the user to the tubular base member for styling the hair of the user.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION OF DIFFERENT EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is therefore indicated by the appended claims rather than by the foregoing description. All changes that come within the meaning and range of equivalency of the claims are to be embraced within their scope.

Figure 1:
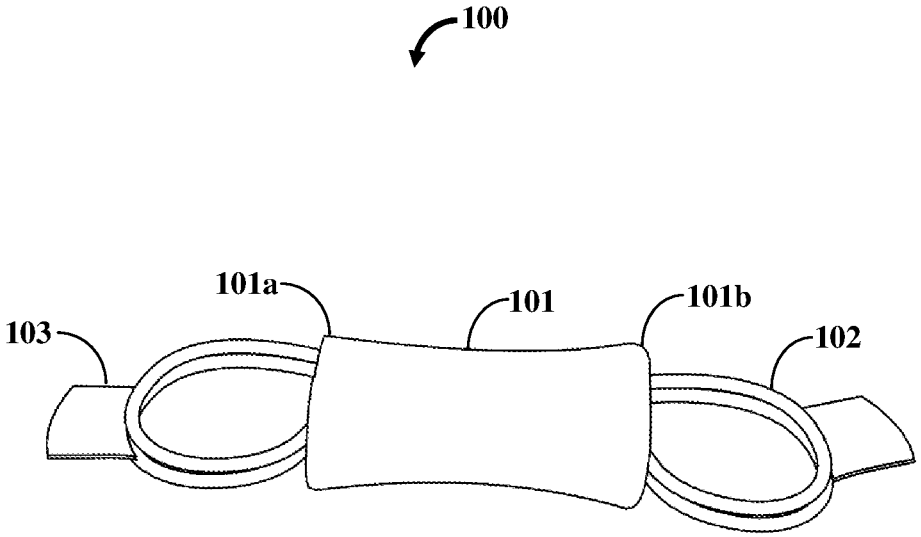
FIG. 1 exemplarily illustrates a top perspective view of a hair styling apparatus.

FIG. 1 exemplarily illustrates a top perspective view of a hair styling apparatus 100. The present invention provides the hair styling apparatus 100 that can be utilized to curl and style one's hair without the use of heat or an electrical outlet. In an embodiment, the hair styling apparatus 100 for styling hair of a user comprises a tubular base member 101, elastic loop elements 102, and gripping members 103. The tubular base member 101 comprises a first end 101*a* and a second end 101*b*. In an embodiment, the tubular base member 101 receives and rolls hair of a user. In an embodiment, the tubular base member can be constructed with various different colors. The elastic loop elements 102 are positioned on the first end 101*a* and the second end 101*b* of the tubular base member 101. In an embodiment, the elastic loop elements 102 are fixedly attached to the first end 101*a* and the second end 101*b* of the tubular base member 101. The gripping members 103 are fixedly attached to each of the elastic loop elements 102 for overlapping the elastic loop elements 102 over the tubular base member 101. The gripping members 103 enable the user to grasp the elastic loop elements 102 on the first end 101*a* and the second end 101*b* thereof the tubular base member 101 when applying it to one's hair. The elastic loop elements 102 securely fasten the hair of the user to the tubular base member 101 for styling the hair of the user.

Figure 2:
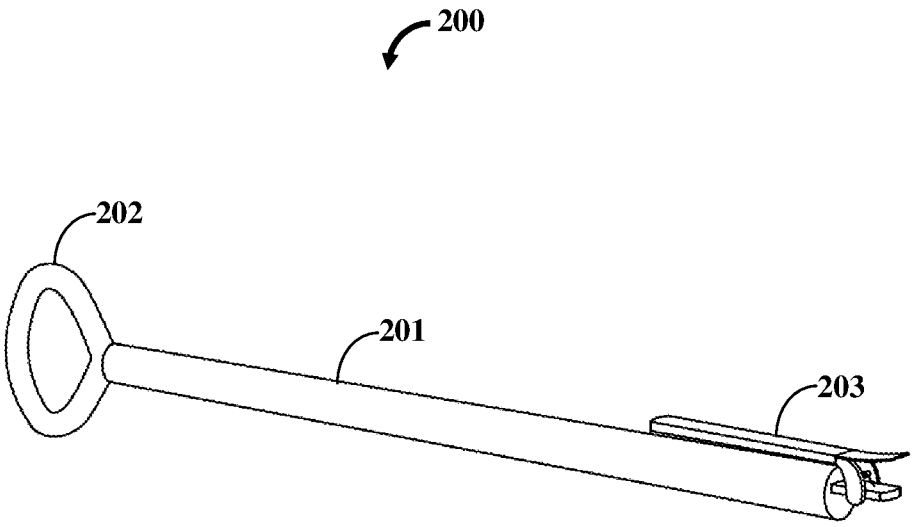
FIG. 2 exemplarily illustrates a side perspective view of a hair styling elongate device.

FIG. 2 exemplarily illustrates a side perspective view of a hair styling elongate device 200. In an embodiment, a plurality of hair styling apparatuses 100 and a plurality of hair styling elongate device 200 are provided in a kit. The hair styling kit for styling hair of a user comprises hair styling apparatuses 100 and hair styling elongate device 200 as exemplarily illustrated in FIGS. 1-2. Each of the hair styling apparatuses 100 comprise a tubular base member 101, elastic loop elements 102, and gripping members 103 as exemplarily illustrated in FIG. 1. The hair styling elongate device 200 comprises an elongate base member 201, a handle 202, and a clip member 203 as exemplarily illustrated in FIG. 2. The hair styling device's elongate base member 201 is used to achieve higher definition in rolling the hair of a user. In an embodiment, the handle 202 is of a looped configuration. The clip member 203 is located distal to the handle 202 of the hair styling elongate device 200. The clip member 203 enables a user to secure his or her hair to the hair styling elongate base member 201. The clip member 203 of the hair styling elongate device 200 is utilized to enhance the curls of the user's hair. The present invention provides a hair styling kit that can be utilized to curl, style, and groom one's hair without having to use a heated curling iron and/or other hair tools.

Figure 3:
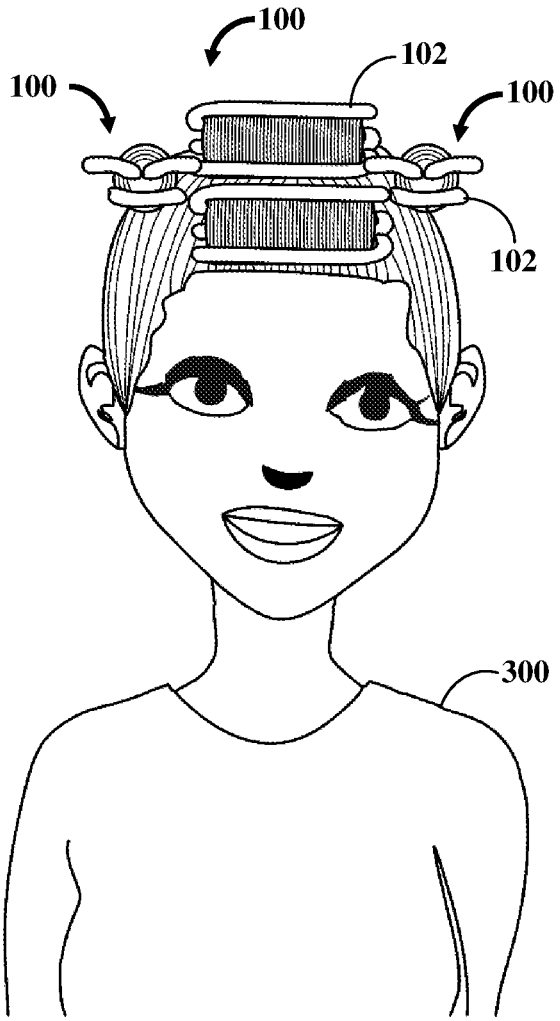
FIG. 3 exemplarily illustrates a user wearing multiple hair styling apparatuses for styling hair.

FIG. 3 exemplarily illustrates a user 300 wearing multiple hair styling apparatuses 100 for styling hair. The user 300 places her hair around the tubular base member 101 of the hair styling apparatus 100. The user 300 then holds the gripping members 103 on each of the elastic loop elements 102 of the hair styling apparatus 100 to pull and stretch the elastic loop elements 102 in order to attach them to one another to secure the hair styling apparatus 100 in the hair. The hair styling apparatus 100 is flexible and enables the user 300 to manipulate the hair styling apparatus 100 when being applied to one's hair. In an embodiment, the tubular base member 101 of the hair styling apparatus 100 is constructed from flexible materials, for example, spongy materials, foam, plastic, satin, elastic, rubber, etc. In an embodiment, the tubular base member 101 is covered in a satin material in order to prevent tangling and for easy application of the hair styling apparatus 100 into one's hair. The hair styling apparatus 100 is made in various colors, shapes, and sizes in order to suit different hair types and textures. In an embodiment, the tubular base member 101 is made from a spongy tube with a satin covering. The elastic loop elements 102 are made of a flexible plastic or cloth covering over an elastic wire. When supplied as a kit as disclosed in the detailed description of FIG. 2, multiple hair styling apparatuses 100 are stacked on top of one another and supplied with a hair styling elongate device 200 in a clear carrying case for storage.

Figure 4:
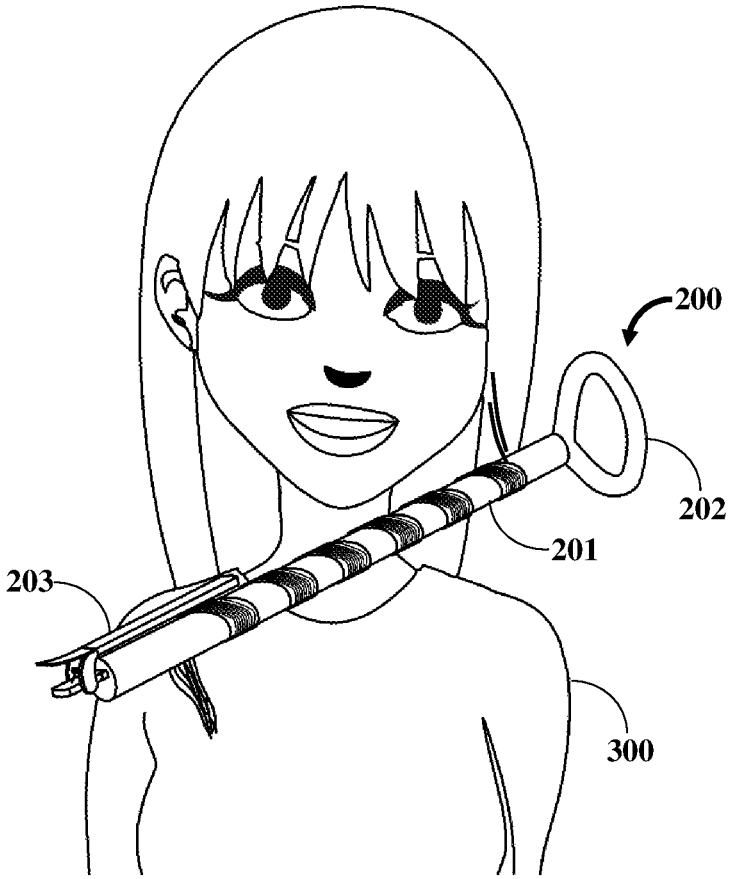
FIG. 4 exemplarily illustrates a user employing a hair styling elongate device for curling hair to add definition to the hair if desired.

FIG. 4 exemplarily illustrates a user 300 employing a hair styling elongate device 200 for curling hair. The user 300 utilizes the hair styling elongate device 200 for curling hair in multiple ways. For example, an individual may style their hair into a bun and roll a small quantity of hair onto the tubular base member 101 of the hair styling apparatus 100 as exemplarily illustrated in FIG. 3. Then, the elastic loop elements 102 are pulled to the left and right sides for overlapping over one another and securing the hair to the tubular base member 101. The user 300 may leave the hair styling apparatus 100 applied to one's hair while sleeping and remove the hair styling apparatus 100 in the morning after waking up. The user 300 can then apply the hair styling elongate device 200 to one's hair in the morning to enhance the style and curl of one's hair. After the hair styling apparatus 100 is removed, the user 300 wraps the hair around the hair styling elongate device base member 201 to give the user's hair more definition and a modern style without the use of heat. Furthermore, if the user 300 has additional time, the user 300 can secure the hair in place via applying the clip member 203 to the elongate base member 201 of the hair styling elongate device 200. Only a few minutes of use of the hair styling apparatus 100 and the hair styling elongate device 200 are needed to give the user's 300 hair a beautiful style. In an embodiment, the hair styling apparatus 100 is constructed from materials, for example, foam, spongy materials, etc. In an embodiment, the hair styling apparatus 200 is constructed from materials, for example, wood, plastic, metal, etc. In an embodiment, the hair styling apparatuses 100 and 200 are made in different colors, sizes, etc., to suit user preferences. The exact size, measurement, construction, and design specifications may vary upon manufacturing.

The foregoing examples have been provided merely for the purpose of explanation and are in no way to be construed as limiting of the hair styling apparatus 100 and kit, disclosed herein. While the hair styling apparatus 100 and kit have been described with reference to various embodiments, it is understood that the words, which have been used herein, are words of description and illustration, rather than words of limitation. Further, although the hair styling apparatus 100 and kit, have been described herein with reference to particular means, materials, and embodiments, the hair styling apparatus 100 and kit are not intended to be limited to the particulars disclosed herein; rather, the hair styling apparatus 100 and kit extend to all functionally equivalent structures, methods and uses, such as are within the scope of the appended claims. Those skilled in the art, having the benefit of the teachings of this specification, may effect numerous modifications thereto and changes may be made without departing from the scope and spirit of the hair styling apparatus 100 and kit disclosed herein in their aspects.

What is claimed is:

1. A hair styling kit for styling hair of a user, the hair styling kit comprising:

a plurality of hair styling apparatuses, each of the hair styling apparatuses comprising:
- a tubular base member;
- elastic loop elements; and
- gripping members;

a plurality of hair styling elongated devices, each of the hair styling elongate devices comprising:
- an elongate base member;
- a handle; and
- a clip member.

2. The hair styling kit of claim 1, wherein each tubular base member is of a spongy material.

3. The hair styling kit of claim 1, wherein each elongate device handle is of a looped configuration.

4. The hair styling kit of claim 1, wherein each elongate base member is of one of a hard plastic material, a wooden material, and a sturdy material.

5. The hair styling kit of claim 1, wherein each clip member is of one of a metallic material and a sturdy material.

* * * * *